United States Patent [19]

Rowe, Jr. et al.

[11] 4,102,710

[45] * Jul. 25, 1978

[54] ADJUVANT COMPOSITION FOR SOLVENT PHOSPHATIZING SOLUTION

[75] Inventors: Edward A. Rowe, Jr., Mentor; William H. Cawley, Painesville, both of Ohio

[73] Assignee: Diamond Shamrock Corporation, Cleveland, Ohio

[ * ] Notice: The portion of the term of this patent subsequent to Feb. 15, 1994, has been disclaimed.

[21] Appl. No.: 753,435

[22] Filed: Dec. 22, 1976

[51] Int. Cl.[2] ..... C23F 7/10

[52] U.S. Cl. ..... 148/6.15 R; 260/652.5 R

[58] Field of Search ..... 148/6.15 R; 260/652.5 R

[56] References Cited

U.S. PATENT DOCUMENTS 4,008,101 2/1977 Rowe et al. ..... 148/6.15 R

*Primary Examiner*—Ralph S. Kendall

*Attorney, Agent, or Firm*—John J. Freer

[57] ABSTRACT

Topcoat adhesion is now increased for coatings applied over a solvent phosphatized metallic surface. The phosphatized surface is obtained from a composition that can contain methylene chloride, as well as water in minor amount, and yet maintain a continuous and homogeneous liquid phase. By adding significant amounts of stabilizer to the phosphatizing composition, generally by way of an adjuvant composition, the resulting phosphatized coatings will provide for enhanced topcoat adhesion.

12 Claims, No Drawings

ADJUVANT COMPOSITION FOR SOLVENT PHOSPHATIZING SOLUTION

BACKGROUND OF THE INVENTION

The use of a stabilizing amount of thymol, among other substances, in methylene chloride has been disclosed in U.S. Pat. No. 2,008,680. This is stabilization against chemical decomposition with commensurate acid development. Similarly, U.S. Pat. No. 2,155,723 has disclosed the like serviceability of, for example, pentaphen (p-tert-amyl phenol), when used in trichlorethylene.

The presence of minor amounts of these stabilizers such as pentaphen, as for example only a few hundred parts per million up to a few hundredths weight percent, has heretofore been shown in the solvent phosphatizing art. Thus, in U.S. Pat. No. 3,361,598, 0.01 weight percent of pentaphen is used along with trichlorethylene in many of the exemplary compositions taught in the patent. With regard, however, to providing coatings, a trichlorethylene-based phosphatizing composition containing 150 parts per million pentaphen did not perform more effectively than a stabilizer-free composition. Such lack of phosphatizing effect has been discussed in U.S. Pat. No. 3,475,228.

Further, the presence of up to 0.03 percent of pentaphen or thymol has actually been found to be unsatisfactory. This is for stabilizing trichlorethylene-based phosphatizing compositions, as has been taught in U.S. Pat. No. 3,281,285. The prior art has also discussed coating performance for such stabilizer-containing compositions, wherein the stabilizer pentaphen is present at the elevated, about 0.01 percent level. U.S. Pat. No. 3,277,120 has shown that a phosphatizing composition containing such level of pentaphen does not provide for satisfactory coating performance.

In pending application Ser. No. 560,378, now U.S. Pat. No. 4008101, there are disclosed phosphatizing compositions which contain methylene chloride and water, while having a continuous and homogeneous liquid phase. Such compositions can provide phosphatized coatings having at least substantial water insolubility. The liquid phase contains water in minor amount, thus retaining the desirable process characteristics associated with solvent phosphatizing.

Such compositions may also contain stabilizer, and it has been taught to typically prepare same to contain about 0.03 weight percent of a stabilizer such as pentaphen. Further, the use of a stabilizer-containing adjuvant composition is disclosed. Such adjuvant might be expected to contain up to one weight percent of stabilizer.

Resulting phosphatizing metal surfaces are often topcoated. Topcoating can be done with a variety of paints or the like. It would be desirable to achieve excellent topcoat adhesion for such later applied coating compositions.

SUMMARY OF THE INVENTION

Topcoat adhesion can now be significantly enhanced following the making of an adjustment to the constituency of the phosphatizing compostion. And importantly, other attractive aspects of the phosphatized coating are not deleteriously affected. Through significantly augmenting the concentration of particular stabilizer in the phosphatizing composition, phosphate coatings from the resulting composition can have significantly increased topcoat adhesion.

In brief, the invention is directed to a methylene chloride and water-containing liquid phosphatizing composition having a continuous and homogeneous liquid phase containing water in minor amount, with the composition being capable of forming a phosphatized coating of substantial water insolubility on a metal surface. The composition comprises methylene chloride, solubilizing solvent capable of solubilizing phosphoric acid in methylene chloride, a phosphatizing proportion of phosphoric acid, water in an amount exceeding the proportion of phosphoric acid, while being sufficient for the composition to provide a phosphatized coating of substantial water insolubility, and while retaining liquid phase homogeneity, with the composition being particularly characterized by containing phenolic stabilizing substance in an amount above about 0.2 weight percent, basis total composition weight.

In another aspect the invention is directed to a phosphatizing composition adjuvant containing an augmented amount of phenolic stabilizing substance.

DESCRIPTION OF THE PREFERRED EMBODIMENTS

The methylene chloride phosphatizing compositions are disclosed in pending U.S. Application Ser. No. 560,378 now U.S. Pat. No. 4008101. Briefly, they may contain commercially available methylene chloride, which might contain additional ingredients, although the use of a more purified methylene chloride is contemplated. The methylene chloride may then contain very minor amounts of stabilizers such as cyclohexane. The methylene chloride might be blended with additional solvent. Preferably, the additional solvent will be nonflammable and will form an azeotrope with the methylene chloride on heating, e.g., trichloro trifluoroethane, which can be useful in up to a 50/50, by weight, blend. Although the methylene chloride will generally provide the major amount of the liquid phosphatizing solution and will typically provide between about 60 to about 90 weight percent of such solution, this need not be the case. In such situation, the solubilizing solvent will likely be the predominant substituent in the solution.

The solubilizing solvent needs to be one or a mixture that is capable of solubilizing phosphoric acid in methylene chloride. The solvent can also affect other characteristics of the phosphatizing solution, e.g., the solvent may have an effect on the solubility of water in the phosphatizing solution. The solvent can be, and on occasion most desirably is, a blend of organic substances. Most advantageously for efficiency of operation the solubilizing solvent is an alcohol having less than six carbon atoms. Alcohols of six carbon atoms or more may be used, but should always be present in minor amount with at least one less than six carbon atoms alcohol being in major amount. Representative alcohols that can be or have been used include methanol, ethanol, isopropanol, n-pentanol, n-propanol, n-butanol, allyl alcohol, secbutanol, tert-butanol and their mixtures wherein liquid phase homogeneity is maintained when in mixture with methylene chloride. However, additional substances, e.g., 2-butoxyethanol, can also be serviceable, alone or in combination with alcohol. Preferably for efficiency and economy the organic solvent is methanol.

The phosphoric acid is a critical ingredient that is generally present in a very minor amount, but with the solubilizing solvent, the acid may be contained in the phosphatizing solution in substantial amount. Such amount might be up to 2–3 weight percent or more, although an amount below even 0.1 weight percent can be serviceable.

The phosphatizing solution will be useful for phosphatizing aluminum, zinc, cadmium and tin substrates as well as the more typical ferruginous metal substrates. The "phosphatizing proportion of phosphoric acid", as such term is used herein, may well be a "phosphatizing substance", as it might more appropriately be termed. Such terms are not meant to exclude any substances that may be, or have been, useful in the solvent phosphatizing art for providing a phosphate coating. Such substances might thus include organic phosphate substance as well as the more typical acidic substances of phosphorous, e.g., the usual orthophosphoric acid.

The amount of the phosphatizing substance in the phosphatizing solution is exceeded by the amount of water present in such solution. Water must be present in at least an amount sufficient to provide a phosphatized coating on ferrous metal of substantial water insolubility. However, saturation is not exceeded as the solution will then lose liquid phase homogeniety. For many of the phosphatizing solutions, on one hand water insoluble coatings are achieved, coupled with an acceptable coating weight, when the water content of the solution reaches about 1.5–2.5 weight percent. On the other hand, phase separation for many solutions can occur when the water content reaches about 5–7 weight percent, basis total solution weight. The water will always provide a minor weight amount of the phosphatizing solution, and it will most always be present in an amount within the range of about 2–5 weight percent.

The other critical ingredient in the phosphatizing composition is the phenolic stabilizing substance. This substance can be phenol or substituted phenol having one or more ring substituents that are either alkyl or alkoxy. The phenolic stabilizing substance can also be a bis-phenol or a bisphenol having connecting alkyl ring linkage, i.e., bisphenol-A. Further, the bis-phenols can have, on each ring, one or more of alkyl and alkoxy substituents. All of such alkyl substituents are preferably lower alkyl of six carbon atoms or less. Likewise, the alkoxy substituents will have six carbon atoms or less. Although these stabilizing substances are likely solid before typical use, many if not all are soluble in methylene chloride as well as in the solubilizing solvent.

The coating composition should contain at least about 0.2 weight percent of the phenolic stabilizing substance. Less than this will not provide sufficient substance for yielding enhanced adhesion for topcoats applied over the resulting phosphatized coatings. Advantageously, the phosphatizing composition for economy will not contain greater than about one weight percent of the stabilizer substance. Preferably for efficiency and economy, such substance is present in the composition in an amount between about 0.25–0.6 weight percent basis total composition weight. Substituted phenols that are useful as the stabilizing substance in addition to such mentioned hereinabove, include thymol, p-tertiary butyl phenol, p,p'-bisphenyl methane, butylated hydroxy toluene, p-tertiary amyl phenol, hydroquinone monomethyl ether, and their mixtures.

The "phosphatizing solution", "phosphatizing composition", or "methylene chloride and water-containing liquid phosphatizing composition", as such terms are used herein, will always contain methylene chloride, solubilizing solvent, phosphatizing proportion of phosphoric acid and water, in addition to phenolic stabilizing substance. A further substance that may be present in the phosphatizing solution is an aprotic organic substance. It is preferred for efficient coating operation to use dipolar aprotic organic compounds, and such are generally present in an amount less than the amount of the solubilizing solvent. Although they are serviceable when used on the order of ten to fifteen weight percent or more of the composition, enhanced topcoat adhesion may be obtained with resulting coatings from compositions to which about 3 to about 5 weight percent of compound have been added. The aprotic organic compound is often a nitrogen-containing compound; these plus other useful compounds include N,N-dimethyl formamide, dimethyl sulfoxide, acetonitrile, acetone, nitromethane, nitrobenzene, tetramethylenesulfone and their inert and homogeneous liquid mixtures where such exist. By being inert, it is meant that such mixtures do not contain substituents that will chemically react with one another, in the phosphatizing solution, at the temperature attained for the solution to be at boiling condition. Dimethyl sulfoxide is useful as an aprotic organic compound; but, such may further be used as an accelerator compound, as is mentioned herein below. In such case when the diemthyl sulfoxide is present as an accelerator compound, substance other than dimethyl sulfoxide is used to supply aprotic organic compound.

Another substance generally found in the phosphatizing composition is the organic accelerator compound. Such compound serves to increase the rate of formation of the coating during the phosphatizing process. Many of the useful accelerator compounds are nitrogen-containing organic compounds, and compounds that can be used include urea, pyridine, thiourea, dimethyl sulfoxide, dimethylisobutyluene amine, ethylenediaminetetraacetic acid and dinitrotoluene. The use of additional stabilizers, other than those discussed hereinabove, and which have been taught in the prior art are also contemplated. Such additional stabilizer compounds can include quinone, p-benzoquinone and hydroquinone.

A pre-packaged blend has been found to be serviceable not only for maintenance of a phosphatizing composition that is being worked but also in the make-up of a fresh phosphatizing composition. Such blend, or adjuvant composition as it is usually termed herein, may be pre-packaged for storage and/or handling. Most usually, the solubilizing solvent will comprise the major amount of this adjuvant composition, and preferably will supply between about 55–80 weight percent of the composition. Further, the water and aprotic organic compound may be present in substantially equivalent amounts. Each ingredient will generally be present in an amount between about 10–30 weight percent. It is most important that this adjuvant contain one weight percent or more, basis total adjuvant composition weight, of phenolic stabilizing substance. This amount can help assure the presence in the phosphatizing composition of above about 0.2 weight percent of such stabilizing substance. Advantageously for economy, the adjuvant will not contain more than about 5 weight percent of phenolic stabilizing substance. Additional ingredients, e.g., accelerator compound or additional stabilizer compounds mentioned hereinabove, are each often present in an amount less than one weight percent, basis the weight of such adjuvant composition.

The methylene chloride containing phosphatizing composition is suitable for use with any of the phosphatizing operations that can be, or have been, used with solvent phosphatizing. During phosphatizing, which will take place typically in degreaser apparatus, the vapor zone, in addition to containing trace amounts of other substances, will be found to contain methylene chloride vapor, vapor from the solubilizing solvent that solubilized the phosphoric acid in the methylene chloride as well as water vapor.

The phosphatizing composition will provide a desirable phosphate coating in fast operation. Such operation may provide the phosphatized substrate with a low-coating weight, i.e., one on the order of 20–50 milligrams per square foot, or with a heavier coating weight. Such heavier coating weight, of usually above about 50 milligrams per square foot can be on the order of 100 or more, e.g., 150 milligrams per square foot.

The coatings that are obtained on ferrous metal will have at least substantial water insolubility, also termed "waterresistant" coatings. For determing water solubility, the test employed is sometimes referred to as the "water soak test". In this test a coated ferruginous article is weighed and then immersed in distilled water for ten minutes. The water is maintained at room temperature, typically 65°–75° F, and with no agitation. After this 10 minute immersion, the article is removed from the water, rinsed in acetone and air dried. Subsequently, on re-weighing, the amount of water solubility of the coating is shown by any weight loss. This loss is generally expressed as a percentage loss of the total original coating. The method used for determining the original coating weight has been more specifically described hereinbelow.

Advantageously, for enhanced corrosion protection, the water solubility of the coating will be on the order of less than 20% as determined by the water soak test. Such a coating, for convenience, can be termed as a "phosphatized coating fo substantial water insolubility". Preferably, for best coating performance, including the ability to receive topcoating with water-based topcoat compositions, the water solubility of the coating will be less than 5%, basis total weight of the original coating.

Coatings from the phosphatizing operation that are of the iron phosphate type have been subjected to analysis by the Electron Spectroscopy for Chemical Analysis (ESCA) technique. Such analysis confirms that the coatings obtained on a ferruginous substrate, contain in their make-up, the elements sodium and calcium in trace amounts. The balance of the elements is provided by phosphorous, iron, oxygen, carbon and nitrogen.

Although all of the coatings are complex, because of the nature of the spectroscopic analysis techniques used in analyzing the coating, the make-up of the coating under analysis is expressed in the form of the elements, although the elements will or may form various bonding relationships.

Because of the augmented topcoat adhesion plus the water-resistant phosphatized coating the coating lends itself to topcoating from electrically-deposited, aqueous-based primers, such as the electrodeposition of film-forming materials in the well known electrocoating processes. Further, the phosphatized coatings can form the base coating for a water reductible topcoating. Such topcoating compositions typically contain solubilized polymers, similar to conventional alkyd, polyester, acrylic and epoxy types, that are typically solubilized with smaller amounts of organic amine. Also the resulting phosphate coating substrate can be further topcoated with any other suitable resin-containing paint or the like, i.e., a paint, primer, enamel, varnish or lacquer including a solvent preduced paint. Additional suitable paints can include the oil paints and the paint system may be applied as a mill finish.

Before applying the phosphate coating, it is advisable to remove foreign matter from the metal surface by cleaning and degreasing. Although degreasing may be accomplished with commercial alkaline cleaning agents which combine washing and mild abrasive treatments, the cleaning will generally include degreasing. Although such degreasing can be accomplished with typical degreasing systems, such degreasing can be readily and efficiently handled with methylene chloride degreasing solvent.

The following example shows a way in which the invention has been practical but should not be construed as limiting the invention.

EXAMPLE

A composition for sustaining phosphatizing by addition to a phosphatizing bath is prepared by blending together 93.28 parts methylene chloride, 5.99 parts methanol, 0.71 part water, 0.01 part p-tertiaryamyl phenol (referred to hereinafter simply as "pentaphen") and 0.01 part p-benzoquinone. Hereinafter, the resulting homogeneous, stable solution is referred to as the "sustaining solution".

For comparative purposes there is separately prepared, by blending together into a homogeneous solution, 62.64 parts methanol, 17.57 parts water, 19.24 parts N,N-dimethylformamide, 0.38 part dinitrotoluene, 0.12 part pentaphen, and 0.044 part p-benzoquinone. This is referred to hereinafter as a "comparative" precursor composition. One part by volume of this resulting uniform solution is then blended with three parts by volume of the sustaining solution. To this resulting homogeneous blend there is then added sufficient orthophosphoric acid to provide about 0.55% by weight of the orthophosphoric acid in the resulting blend. Such blend is then termed the "comparative bath".

For improvement purposes other precursor compositions are prepared as described hereinabove, except that such compositions contain 1.37 and 2.11 parts of pentaphen. These are the "improved" precursor compositions. Phosphatizing baths are made with these improved precursor compositions in the manner described above to contain 0.2 and 0.4 weight percent of pentaphen, as shown in the table below. These are "improved" baths. These baths, and the comparative bath, are each then separately heated to reflux and maintained in such condition for about seven days to prepare same for phosphatizing.

Bare steel test panels, being 6 inch × 4 inch cold-rolled, low carbon steel panels are used for phosphatizing. The panels are typically prepared for phosphatizing by degreasing for 15 seconds in a commercial, methylene chloride degreasing solution mainted at about 104° F. Panels are removed from the solution, permitted to dry in the vapor, and are thereafter ready for phosphatizing. The panels are phosphatized by immersing the panels in the selected bath, first heated to its boiling point and maintained there during phosphatizing. Immersion time is 1 minute. Panels removed from the respective phosphatizing baths pass through the vapor zone above such bath until liquid drains from the panel; dry panels are then removed from the vapor zone.

For all compositions, that is, the comparative bath as well as the improved baths, the coating weight is approximately 40 milligrams per square foot (mg/ft$^2$) of phosphate coating on the panels as determined by visual observation of a bluegold coating coloration.

Some of the test panels, selected at random, are spray painted with a commercial gray enamel topcoat. The spray equipment is a disposable Sprayon Jet Pad using a dichlorodifloromethane propellant. The enamel is a baking enamel that ostensibly contains a modified alkyd resin based upon a system of partially polymerized phthalic acid and glycerine, and has 50 weight percent solids. After coating, coated panels are cured by baking in a convection oven for 25 minutes at a temperature of 300° F. Coating thickness is about one to about 1.5 mil, which from experience, is regarded as only a minor variation in paint thickness for the reverse impact test when using the same paint system with each panel.

As shown in the Table below, selected panels are subjected to the reverse impact test. In this test the weight of the metal ram is coordinated with the height of the drop to provide both 80 inch-pounds and 160 inch-pounds (in-lb) as shown in the Table below. Paint removal is determined qualitatively by first taping the convex (reverse) surface of comparative panels before testing, then removing the tape following testing and rating them by visual observation of the tape. In the rating system the following numbers are used to cover the following results:

(10) complete retention of film, exceptionally good for the test used;
(8) some initial coating degradation;
(6) moderate loss of film integrity;
(4) significant film loss, unacceptable degradation of film integrity;
(2) some coating retention only;
(0) complete film loss.

TABLE

| Bath | Pentaphen* Content of Bath | Reverse Impact 80 in-lb | Reverse Impact 160 in-lb |
|---|---|---|---|
| Comparative Bath | 0.12 | 5 | 0 |
| Improved Baths: | | | |
| First | 0.2 | 10 | 10 |
| Second | 0.4 | 10 | 10 |

*p-tertiary amyl phenol

We claim:

1. In a methylene chloride and water-containing liquid composition having a continuous and homogeneous liquid phase suitable for phosphatizing metal with a coating of at least substantial water insolubility, with said liquid phase containing water in minor amount, which composition comprises methylene chloride, solubilizing solvent capable of solubilizing phosphoric acid in methylene chloride, a phosphatizing proportion of phosphoric acid, and water in an amount exceeding said proportion of phosphoric acid, while being sufficient for said composition to provide a phosphatized coating of substantial water insolubility, and while retaining liquid phase homogeneity, the improvement which comprises said composition being characterized by containing phenolic stabilizing substance in an amount above about 0.2 weight percent, basis total composition weight, wherein said phenolic stabilizing substance is selected from the group consisting of phenol, substituted phenols having one or more ring substituents selected from the group consisting of alkyl and alkoxy, bis-phenols, bis-phenols having connecting alkyl ring linkage, and any of said bis-phenols having one or more substituents on each ring which are selected from the group consisting of alkyl and alkoxy.

2. The composition of claim 1 wherein the methylene chloride supplies the major amount of said composition.

3. The composition of claim 1 wherein the solubilizing solvent is an alcohol having less than 6 carbon atoms.

4. The composition of claim 1 further characterized by containing substance selected from the group consisting of aprotic polar organic compound, organic accelerator compound and mixtures thereof.

5. The composition of claim 1 wherein the phenolic stabilizing substance is selected from the group consisting of thymol, p-tertiary butyl phenol, p,p'-bisphenyl methane, butylated hydroxy toluene, p-tertiary amyl phenol, bisphenol-A, hydroquinone monomethyl ether, and their mixtures.

6. The composition of claim 1 characterized by containing methylene chloride, methanol, phosphoric acid, water and p-tertiary amyl phenol.

7. The composition of claim 1 characterized by containing between about 0.2–1 weight percent of said phenolic stabilizing substance.

8. In a storage-stable liquid adjuvant composition, useful in preparing a methylene-chloride-containing liquid phosphatizing medium having a homogeneous liquid phase containing water in minor amount, wherein said phosphatizing medium can provide a uniform coating of at least substantial water insolubility on the surface of a metal of the class capable of reacting with phosphoric acid, which composition is a homogeneous blend containing solubilizing solvent capable of solubilizing phosphoric acid in methylene chloride, aprotic polar organic compound, organic accelerator compound for said phosphatizing medium and water, the improvement which comprises said composition being characterized by containing phenolic stabilizing substance in an amount of one weight percent or more, basis total adjuvant composition weight, wherein said phenolic stabilizing, substance is selected from the group consisting of phenol, substituted phenols having one or more ring substituents selected from the group consisting of alkyl and alkoxy, bis-phenols, bis-phenols having connecting alkyl ring linkage, and any of said bis-phenols having one or more substitutents on each ring which are selected from the group consisting of alkyl and alkoxy.

9. The composition of claim 8 further characterized by containing substance selected from the group consisting of phosphoric acid, a quinone and their mixtures.

10. The composition of claim 8 wherein the phenolic stabilizing substance is selected from the group consisting of thymol, p-tertiary butyl phenol, p,p'-bisphenyl methane, butylated hydroxy toluene, p-tertiary amyl phenol, bisphenol-A, hydroquinone monomethyl ether, and their mixtures.

11. The composition of claim 8 characterized by containing methanol, water, N,N-dimethylformamide, dinitrotoluene and p-tertiary amyl phenol.

12. The composition of claim 8 characterized by containing between about 1–5 weight percent of said phenolic stabilizing substance.

* * * * *